US005800009A

United States Patent [19]

Grandfield

[11] Patent Number: 5,800,009

[45] Date of Patent: Sep. 1, 1998

[54] HANDS-FREE RECLINER

[76] Inventor: Miles Grandfield, 5036 Riverton Ave. #1, Los Angeles, Calif. 91601-3977

[21] Appl. No.: 890,236

[22] Filed: Jul. 9, 1997

Related U.S. Application Data

[63] Continuation-in-part of Ser. No. 631,006, Apr. 12, 1996, Pat. No. 5,653,498.

[51] Int. Cl.[6] ..... A47C 1/02

[52] U.S. Cl. ..... 297/85; 297/68

[58] Field of Search ..... 297/85, 83, 84, 297/68, 423.19, 463.1; 292/19, 78, 80

[56] References Cited

U.S. PATENT DOCUMENTS

| | | | |
|---|---|---|---|
| 1,493,794 | 5/1924 | Robertson | 292/DIG. 4 |
| 2,817,554 | 9/1957 | Hasselmark | 292/DIG. 4 |
| 3,189,374 | 6/1965 | Mertes | 292/DIG. 4 |
| 3,802,735 | 4/1974 | Re . | |
| 4,185,870 | 1/1980 | Johnson | 297/84 |
| 4,494,793 | 1/1985 | Rogers, Jr. . | |
| 4,506,926 | 3/1985 | Griggs, Jr. . | |
| 4,519,647 | 5/1985 | Rogers, Jr. . | |
| 4,792,165 | 12/1988 | Nishimura | 292/DIG. 4 |
| 5,013,084 | 5/1991 | May . | |
| 5,056,862 | 10/1991 | May et al. . | |
| 5,137,328 | 8/1992 | Smith et al. . | |

*Primary Examiner*—Milton Nelson, Jr.

[57] ABSTRACT

A reclining chair, including a leg-rest-operated reciprocating latch for releasably retaining the leg rest. The leg rest linkage is retracted when the occupant applies force to the leg rest in a generally rearward direction until the parts of the latch engage one another to retain the leg rest in the retracted position. The latch is released by a second, momentary application of force in the same direction, enabling the leg rest to move to an extended position. An occupant-weight-actuated lock member prevents the latch from being released unless the chair is occupied by a person weighing more than a minimum amount. The lock member includes an adjustment device by which the minimum occupant weight required to permit operation of the chair can be varied.

16 Claims, 2 Drawing Sheets

HANDS-FREE RECLINER

BACKGROUND-CROSS-REFERENCE TO RELATED APPLICATION

This application is a Continuation-In-Part of my earlier filed application, Ser. No. 08/631,006, filed 1996 April 12, now Pat. No. 5,653,498.

BACKGROUND—FIELD OF INVENTION

This invention relates to reclining furniture and more particularly to recliners that have spring- and/or gravity-actuated recliner mechanisms.

BACKGROUND—DESCRIPTION OF PRIOR ART

Recliners, including motion chairs, sofas, and sectional seating, have enjoyed great popularity in the furniture industry for many years. Spring- and/or gravity-actuated recliner mechanisms are well known in this art. They are normally retained in an upright and retracted position by one or more latching members incorporated into the mechanism of the chair. Ordinarily, these latches take the form of toggle locks, hook latches, or over-center lock links. Such devices are commonly overcome or released by pushing on the arms of the chair or by manipulating a handle or lever which is mechanically linked to the latch. When the latch is released, tensioned springs and/or the body weight of the occupant act on the recliner mechanism to move the chair from an upright to a primary extended position. The chair is returned to its upright position by rotating the handle in the reverse direction or by applying force to the leg rest rearwardly until the latch or latches re-engage to hold the chair in its original state.

A different way of latching and releasing recliner mechanisms has recently been developed and is described in my above mentioned patent. The recliner of that invention uses the concept of reciprocating action to retain and release the leg rest linkage. The action is similar to that of push-release touch latches sometimes used in cabinet closures. To retract the leg rest, muscular force from the occupant's legs is applied to the leg rest rearwardly until the latch is engaged to retain the chair in an upright and retracted position. The novelty of the invention lies in the manner in which the mechanism is activated. A second, momentary application of force in the same generally rearward direction releases the latch and so enables the legrest to move to an extended position. To the best of my knowledge, no recliner mechanism has ever been combined with a reciprocating latch device to provide a leg rest operated, hands-free recliner.

In recent years, attention has been drawn to the obvious concerns presented when unattended children try to operate reclining furniture. These concerns are especially relevant in the context of my previously referred-to invention because the mechanism can be released by any sufficiently forceful impact to the leg rest. One possible solution is to use a device like the one described in U.S. Pat. No. 4,185,870 to Johnson (1980). That patent claims a latch that prevents extension of the leg rest if the chair is unoccupied. However Johnson's device does not prevent the chair from being operated by a small child who might be sitting in the chair.

OBJECTS OF THE INVENTION

Accordingly, it is the object of the present invention to provide a leg-rest-operated reclining chair which can be extended only if it is occupied by a person weighing more than a designated minimum amount. In this way, the chances of mishaps involving children are minimized. The invention includes a means of adjusting the minimum occupant weight (enabling weight) required to allow operation of the chair.

SUMMARY OF THE INVENTION

A reclining chair constructed in accordance with the present invention is comprised generally of a base, a seat, a back rest, and a leg rest which is moveable between an end-limited retracted position and one or more extended positions by means of a conventional spring- and/or gravity-actuated recliner mechanism. A leg-rest-operated reciprocating latch member is used to releasably retain the leg rest in the retracted position. The leg rest linkage is retracted when the occupant applies force to the leg rest in a generally rearward direction until the latch is engaged to retain the leg rest in the retracted position. A drive means is incorporated in the mechanism which stores energy during retraction of the leg rest and drives the leg rest to an extended position when the latch is released. The latch is automatically released by a second, momentary application of force in the same generally rearward direction.

An occupant-weight-operated lock member prevents the latch from being released unless the chair is occupied by a person weighing more than a predetermined minimum amount. In its simple form illustrated, the lock member includes a slideable shaft with a blocking member at one end that normally prevents the latch from being released. The opposite end of the shaft is proximal to the underside of the seat. When the seat is deflected sufficiently, the slideable shaft moves the blocking member out of its normal blocking position. The chair can then be operated at the will of the occupant. When the occupant rises from the chair, a spring returns the blocking member to the blocking position. The length of the shaft is adjustable in order to provide the following functional advantages:

- the device can be adjusted to fit a wide variety of cushioning systems and frame structures commonly used in motion seating;
- almost any given enabling weight can be designated and set according to the preferences of the manufacturer or consumer;
- the recliner mechanism can be completely disabled by adjusting the shaft to a minimum length; and
- conversely, the blocking feature can be disabled by adjusting the shaft to a maximum length.

These features will be better understood from the following detailed description and accompanying drawings.

DRAWING FIGURES

DETAILED DESCRIPTION

Figure 1:
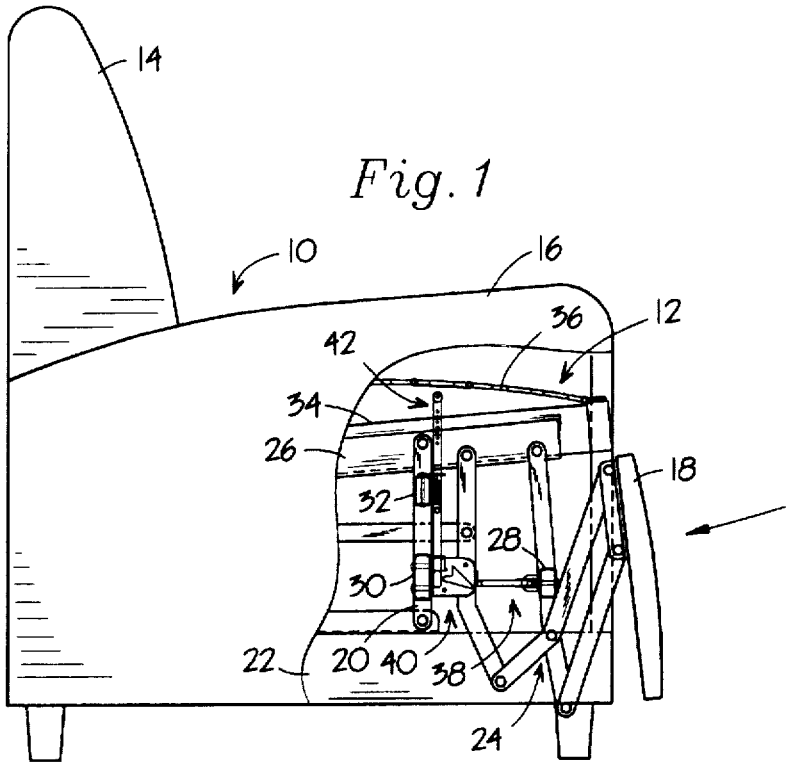
FIG. 1 is a side view of a typical embodiment of the invention with a portion of the upholstery removed to reveal the leg rest linkage partially retracted.

A reclining chair in accordance with a preferred embodiment of the present invention is depicted in FIG. 1. It is of the type commonly known as a two-position spring-actuated recliner. The chair 10 comprises a deflectable seat 12, a back rest 14, arm rests 16, and a retractable leg rest 18, all mounted to a carriage assembly 20, which is shiftable forwardly and rearwardly on a frame 22. The leg rest 18 is carried by a conventional leg rest linkage 24 which is mounted to a seat mounting link 26. The leg rest linkage 24 is predisposed to move to an extended position by tensioned springs (not shown) in a known way. The carriage assembly 20, leg rest linkage 24, frame 22, and arm rests 16, have left and right sides constructed in mirror image, but only the far side is shown in the illustration. A tubular cross member 28 connects the two sides of the leg rest linkage 24. Tubular cross members 30 and 32 connect the two sides of the carriage assembly 20. The seat 12 is shown with upholstery and padding removed to reveal the seat frame 34 and conventional sinuous seat springs 36 mounted on the frame 34 front-to-back.

Figure 2:
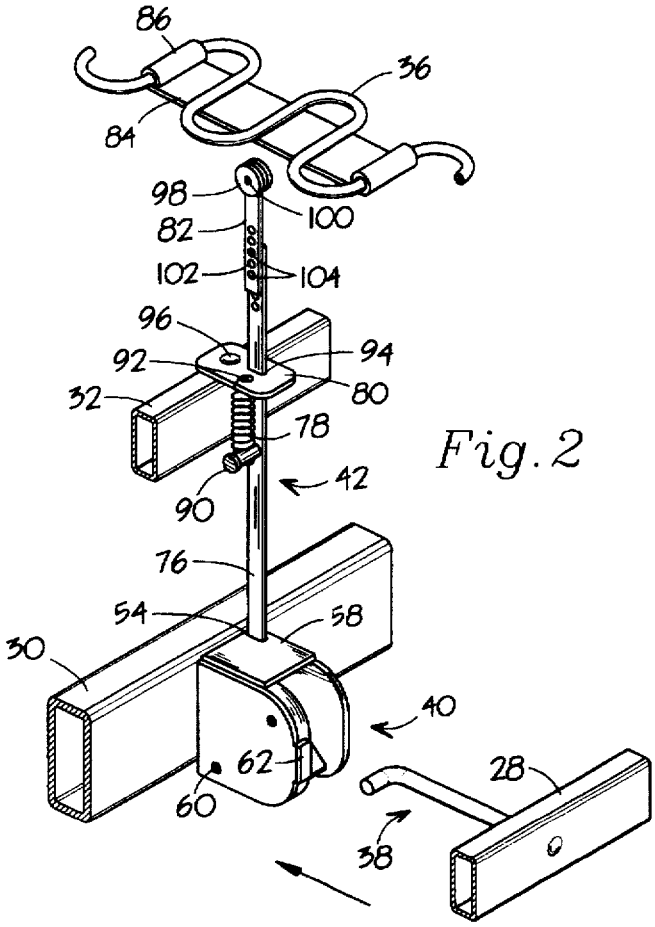
FIG. 2 is a perspective view of a reciprocating latch member and an adjustable, seat-operated safety lock constructed according to a preferred embodiment of the present invention.
Figure 3:
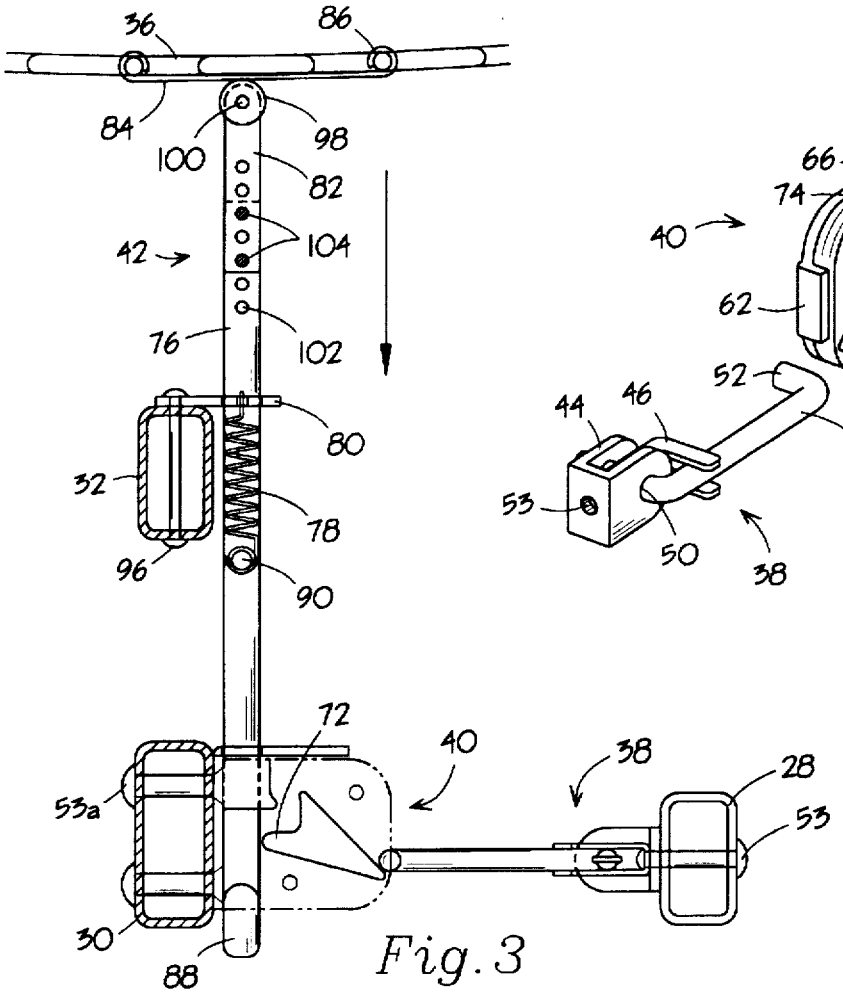
FIG. 3 is a sectional side view of the latch member and lock of FIG. 2 showing the relative position of parts with the lock moved out of the blocking position.

Referring now to FIGS. 2 & 3, an embodiment of the reciprocating latch used in the present invention is shown. Parts of the latch generally labeled as the latch arm assembly 38, the keeper assembly 40, and the lock assembly 42 are shown mounted by rivets near the middle of cross members 28, 30, & 32, respectively. Latch arm assembly 38 and keeper assembly 40 are shown unlatched and in proper alignment.

Figure 4:
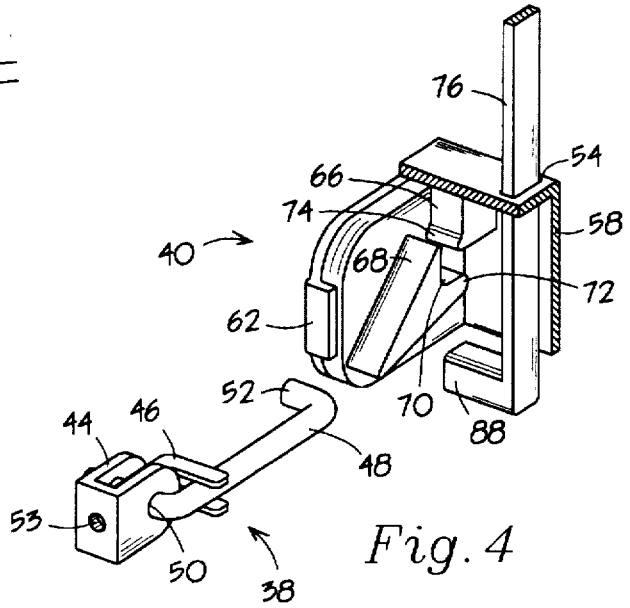
FIG. 4 is a sectional perspective view of the latch member of FIG. 2 showing the relative position of parts with the lock out of the blocking position.
Figure 5:
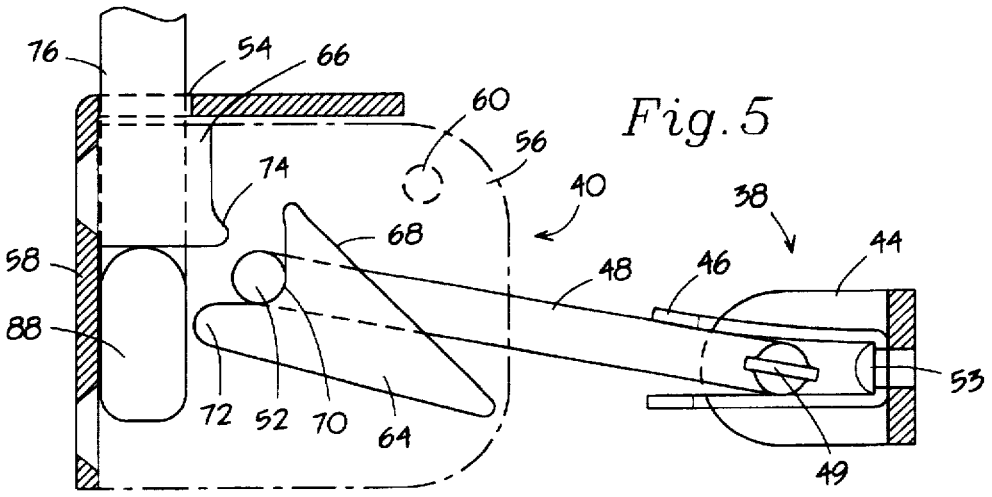
FIG. 5 is a sectional side view of the latch member of FIG. 2 showing the relative position of parts with the lock in the blocking position.

As best seen in FIGS. 4 & 5, the latch arm assembly 38 comprises a U-shaped bracket 44, a centering spring 46, and a latch arm 48. The latch arm 48 has 90-degree bends on either end and is pivotally mounted to the U-shaped bracket 44 by means of pivot holes 50. The latch arm 48 is retained in the bracket 44 by a crimp 49 at its pivotal end. The 90-degree bend at the free end of the latch arm forms a latch pin 52. The centering spring 46 is in the shape of a doubled-over L and is held in place by mounting rivet 53. The spring 46 is used to maintain the pivotally mounted latch arm 48 in a generally horizontal median position. Keeper assembly 40 comprises a keeper 56 which is held in a housing 58 by studs 60 and tabs 62. The housing 58 is preferably made of sheet metal and has a guide slot at 54. The keeper 56 is formed of plastic or metal and includes a catch member 64 and a stop member 66. The catch member 64 comprises a ramp 68, a retaining slot 70, and a guide finger 72. The stop member 66 has a shoulder 74 disposed at its lower end as shown.

The lock assembly 42 is best seen in FIGS. 2 & 3. It generally comprises a locking shaft 76, a tension spring 78, a mounting bracket 80, and an extension shaft 82. A contact platform 84 is shown mounted to the underside of the centermost sinuous seat spring 36 by clinched end loops 86. Locking shaft 76 has a laterally protruding blocker 88 at its lower end (FIGS. 3 & 4). About midway up its length, the locking shaft 76 is fitted with a stud rivet 90. The mounting bracket 80 has a spring mounting hole 92 and a guide slot 94, and is suitably mounted to cross tube 32 as by rivet 96 (FIG. 2). Spring 78 is mounted at its lower end to stud rivet 90, and at its upper end to mounting hole 92. A pair of rollers 98 are mounted on either side of extension shaft 82 with a bearing pin 100. A plurality of evenly spaced holes 102 are provided at the lower end of the extension shaft 82 and at the upper end of the locking shaft 76. The two shafts are connected together with pins 104. Since the holes 102 are evenly spaced, the overall length of the shaft can be adjusted by removing the pins 104 and realigning the holes up or down. The locking shaft 76 passes through slots 94 & 54 as best seen in FIG. 2. Slots 94 & 54 provide enough clearance to allow the shaft 76 to slide freely up and down.

FIG. 2 illustrates the relative position of the seat spring 36 and the lock assembly 42 when the chair is unoccupied. Spring 78 maintains the lock assembly in its uppermost (blocking) position with blocker 88 resting against the underside of stop member 66 (FIG. 5). When someone of sufficient weight sits in the chair, seat spring 36 forces lock assembly 42 downwardly so that blocker 88 is moved substantially below guide finger 72 as in FIGS. 3 & 4.

The latch works as follows. As the legrest is retracted from its extended position, the latch arm assembly 38 moves toward keeper assembly 40 until the latch pin 52 engages ramp 68. The latch pin 52 rides up the ramp and is urged to rotate upwardly against the centering spring 46. The latch pin 52 continues to ride up ramp 68 until it clears the ramp, at which time the centering spring 46 acts to swing the latch arm 48 toward its median position. Its travel is then interrupted by shoulder 74 of stop member 66. At this point the occupant senses that the leg rest cannot be retracted further and so releases pressure on the leg rest. This causes the latch pin 52 to move to the retaining slot 70 as shown in FIG. 5 and there the chair is latched in its upright position. If someone of sufficient weight is seated in the chair, the latch can be released if the occupant momentarily pushes back on the leg rest a second time. This causes the latch pin 52 to ride over the guide finger 72 until its travel is stopped by the back of bracket 58. When pressure on the leg rest is released, the latch arm 48, which still has a bias to move toward its median position, moves below the guide finger 72. The latch arm 48 is now free to travel out of the keeper assembly 40 below catch member 64, and thereby allow the leg rest linkage to move to its predisposed extended position. If the chair is unoccupied or if it is occupied by a person of insufficient weight such as a child, the blocker 88 remains in its effective position as in FIG. 5. Even if the leg rest is deflected rearwardly, the latch arm 48 will encounter the blocker 88 and prevent the arm 48 from moving below the guide finger 72, thus keeping it in the retaining slot 70.

As those skilled in the art will understand, the shape and mounting position of the latch can, and should, be modified to suit the particular design of recliner in which it is to be used. In some models, a flexible cable will be more suitable as a forcible linkage than the rigid shaft of the illustrated lock assembly. The latch depicted in FIGS. 1–5 is provided as a preferred component of the present invention, however other reciprocating latches of sufficient strength and quality may also be used. The above described device embodies characteristics common to many latches of this type. Some examples are shown in U.S. Pat. Nos. 4,792,165 to Nishimura (1988), 3,189,374 to Mertes (1965), 2,817,554 to Hasselmark (1957), and 1,493,794 to Robertson (1924).

OPERATION OF RECLINER

The manner of retracting the leg rest in the improved hands-free reclining chair is identical to that of other manually operated chairs in present use. Muscular force from the occupant's legs is applied to the leg rest in a generally rearward direction until the latch is engaged to retain the chair in an upright and retracted position. Energy is stored during retraction to predispose the linkage to move to the extended position when the latch is released. This preloaded condition provides tension to the latch when it is engaged, enabling it to hold and release as intended in its design. If the chair is occupied by a person of sufficient weight, the latch may be released by a second, momentary application of force in the same rearward direction.

SUMMARY, RAMIFICATIONS, AND SCOPE

In essence, what the invention seeks to provide is a spring- and/or gravity-actuated recliner chair in combination with a reciprocating latch device that enables the user to extend the leg rest by momentarily deflecting the leg rest in a generally rearward direction. The chair includes an occupant-weight-actuated lock member which prevents release of the latch unless the chair is occupied by a person weighing more than a certain minimum amount. It is not intended that the recliner mechanism described above or the latch device with which it is combined be regarded as novel constructions when taken separately. It is the combination of the two that results in the new principle of a leg-rest-operated, hands-free recliner. As many changes could be made in the above construction and many apparently widely different embodiments of this invention could be made without departing from the scope thereof, it is contained in the matter contained in the above description or shown in the accompanying drawings shall be interpreted as illustrative and not in a limiting sense. The full scope of the invention should be determined by the appended claims and their legal equivalents, and not by the examples given.

What is claimed is:

1. In a hands-free reclining chair comprising:

a seat, a backrest, and a leg rest moveable between an extended position forward of said seat and an end-limited rearward position under a front portion of the seat, a mechanism mounted on the chair and carrying the leg rest for providing relative movement between the leg rest and the seat under control of an occupant of the chair, and a latch member mounted on the chair for movement between an effective position at which it prevents said relative movement and an ineffective position at which it permits said relative movement, said latch member being disposed for alternating movement between said effective position and said ineffective position by successive deflections of the leg rest to said end-limited rearward position under muscular force of the occupant, the improvement comprising a resiliently deflectable blocking member mounted on the chair and biased toward a first position at which it blocks movement of said latch member to said ineffective position, said blocking member disposed for forcible movement to a second position at which it permits movement of said latch member to said ineffective position under weight of the occupant, said blocking member including an adjustment means by which the weight required to force said blocking member to said second position can be varied.

2. The chair of claim 1, said latch member comprises a first latch means and a second latch means complimentary to the first latch means.

3. The chair of claim 2 wherein a cross member is disposed on the mechanism and said first latch means is mounted on the cross member and said second latch means is mounted to releasably engage said first latch means when the leg rest is moved to said end-limited rearward position.

4. The chair of claim 3 wherein the seat is resiliently and variably deflectable.

5. The chair of claim 4 wherein the blocking member includes an elongated shaft mounted proximal to the seat.

6. The chair of claim 5 wherein the elongated shaft is flexible.

7. A reclining chair having a deflectable seat and a leg rest which is movable between an extended and a retracted position, a leg rest linkage for moving said leg rest between said extended position when the chair is reclined and said retracted position when the chair is upright, drive means on the chair to drive the leg rest from said retracted position to said extended position, said drive means disposed for storing energy derived from the retraction of said leg rest by actuation of the same in a generally rearward direction by an occupant of the chair, a leg-rest-operated reciprocating latch means for releasably retaining the leg rest in said retracted position, said latch means comprising a first member mounted to and moveable with said leg rest linkage, and a second member disposed to engage the first member and retain the same in said retracted position, said second member being automatically releasable by a second actuation in the same generally rearward direction, and an occupant-weight-actuated lock assembly reversibly moveable at least a certain distance between an effective position at which it prevents the release of said latch means and an ineffective position at which it permits the release of said latch means, said lock assembly being resiliently biased toward said effective position and being forcible said certain distance by said deflectable seat under a predetermined minimum occupant weight, said lock assembly including an adjustment means by which said predetermined weight required to move said lock assembly said certain distance can be varied.

8. The chair of claim 7 wherein the first member is mounted to the leg rest.

9. The chair of claim 7 further including a cross member disposed beneath the seat and said second member is mounted on the cross member.

10. The chair of claim 7 wherein the second member is connected to the drive means.

11. The chair of claim 7 wherein the second member is connected to the seat.

12. The chair of claim 7 having two of said latch means.

13. A recliner chair comprising, in combination:

a seat, a backrest, a leg rest movably mounted on the chair, drive means on the chair to drive said leg rest from an end-limited rearward position under a front portion of said seat to an extended position forward of said seat, said drive means disposed for storing energy derived from retraction of said leg rest by actuation of said leg rest in a generally rearward direction by an occupant of the chair, a leg-rest-operated latch member for releasably retaining said leg rest in a retracted position, said latch member disposed for alternately retaining and releasing said leg rest by successive deflections of said leg rest to said rearward position by said occupant, and a resiliently deflectable lock assembly mounted on the chair and biased toward a first position at which it prevents release of said latch member, said lock assembly disposed for forcible movement under weight of said occupant to a second position at which it permits release of said latch member, said lock assembly including an adjustment means by which the weight required to move said lock assembly to said second position can be varied.

14. The chair of claim 13 wherein said seat is resiliently and variably deflectable.

15. The chair of claim 14 wherein said lock assembly includes an elongated shaft.

16. The chair of claim 15 wherein said elongated shaft is a flexible cable.

* * * * *

UNITED STATES PATENT AND TRADEMARK OFFICE

CERTIFICATE OF CORRECTION

PATENT NO. : 5,800,009
DATED : Sep. 1, 1998
INVENTOR(S) : Miles Grandfield

It is certified that error appears in the above-indentified patent and that said Letters Patent is hereby corrected as shown below:

In column 5, line 22, the phrase "it is contained in the matter" should read --it is intended that all matter--.

Signed and Sealed this
Second Day of March, 1999

*Attest:*

*Attesting Officer*

Q. TODD DICKINSON

*Acting Commissioner of Patents and Trademarks*